US012703970B2

(12) United States Patent
Fryan

(10) Patent No.: US 12,703,970 B2
(45) Date of Patent: Aug. 11, 2026

(54) WASH BASIN WITH DUAL OUTLET OPENINGS SPLIT BY A SMALL PARTITION OF TWO EXTENDING ENDS FOR WATER SEPARATION

(71) Applicant: Hassan Mohamed S. Fryan, Riyadh (SA)

(72) Inventor: Hassan Mohamed S. Fryan, Riyadh (SA)

( * ) Notice: Subject to any disclaimer, the term of this patent is extended or adjusted under 35 U.S.C. 154(b) by 90 days.

(21) Appl. No.: 18/578,907

(22) PCT Filed: Jul. 3, 2022

(86) PCT No.: PCT/SA2022/000008
§ 371 (c)(1),
(2) Date: Jan. 12, 2024

(87) PCT Pub. No.: WO2023/282801
PCT Pub. Date: Jan. 12, 2023

(65) Prior Publication Data

US 2024/0229435 A1 Jul. 11, 2024

(30) Foreign Application Priority Data

Jul. 6, 2021 (SA) ..... 121420876

(51) Int. Cl.
*E03C 1/232* (2006.01)

(52) U.S. Cl.
CPC ..... *E03C 1/232* (2013.01); *E03C 2201/40* (2013.01)

(58) Field of Classification Search
CPC ..... E03C 1/23; E03C 1/232; E03C 1/2306; E03C 1/26; E03C 1/262; E03C 1/264; E03C 1/282; E03C 2201/40
USPC ..... 4/625, 626, 650, 652, 286–295
See application file for complete search history.

(56) References Cited

U.S. PATENT DOCUMENTS

2015/0128339 A1* 5/2015 Warner ..... E03C 1/186 4/514

FOREIGN PATENT DOCUMENTS

| | | | |
|---|---|---|---|
| CN | 2908622 | Y | 6/2007 |
| CN | 2911028 | Y | 6/2007 |
| CN | 201649193 | U | 11/2010 |
| CN | 208039389 | U | 11/2018 |

(Continued)

OTHER PUBLICATIONS

International Search Report for PCT/SA2022/000008, dated Oct. 31, 2022.
Written Opinion for PCT/SA2022/000008, dated Oct. 31, 2022.

*Primary Examiner* — Tuan N Nguyen
(74) *Attorney, Agent, or Firm* — Sughrue Mion, PLLC

(57) ABSTRACT

An excess water slot of dimensions conforming to the recognized dimensions to be installed in place of the previous one but with a different inner design and working by a totally different mechanism. The excess water slot separates pure water from others by a partition in the upper part of the excess water slot extending inside the washbasin and the lower part of the excess water slot ending with two pipe outlets, one for pure water, and the other for turbid water. A small wall is provided with small flexible arms of extending ends to separate water when it falls from the faucet down to the washbasin, and to allow using rubber taps for each half of the excess water slot. One of the two outlets is directed to the public drain system and the other for recycling.

4 Claims, 7 Drawing Sheets

(56) References Cited

FOREIGN PATENT DOCUMENTS

| | | | | | |
|---|---|---|---|---|---|
| FR | 2763085 | A1 * | 11/1998 | ..... | E03C 1/23 |
| WO | 2018/113978 | A1 | 6/2018 | | |

* cited by examiner

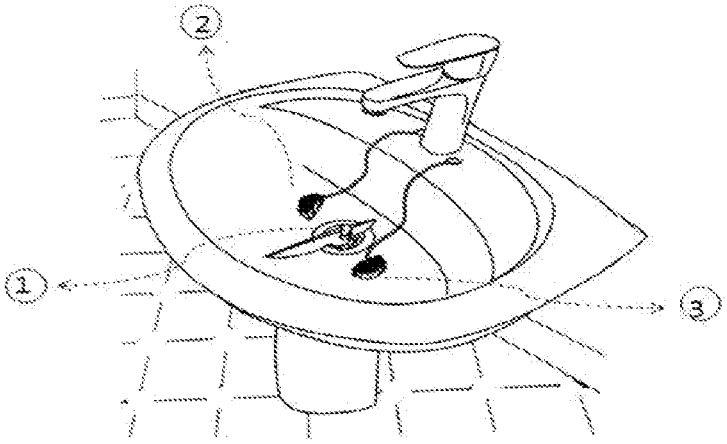
Figure ( 1 )

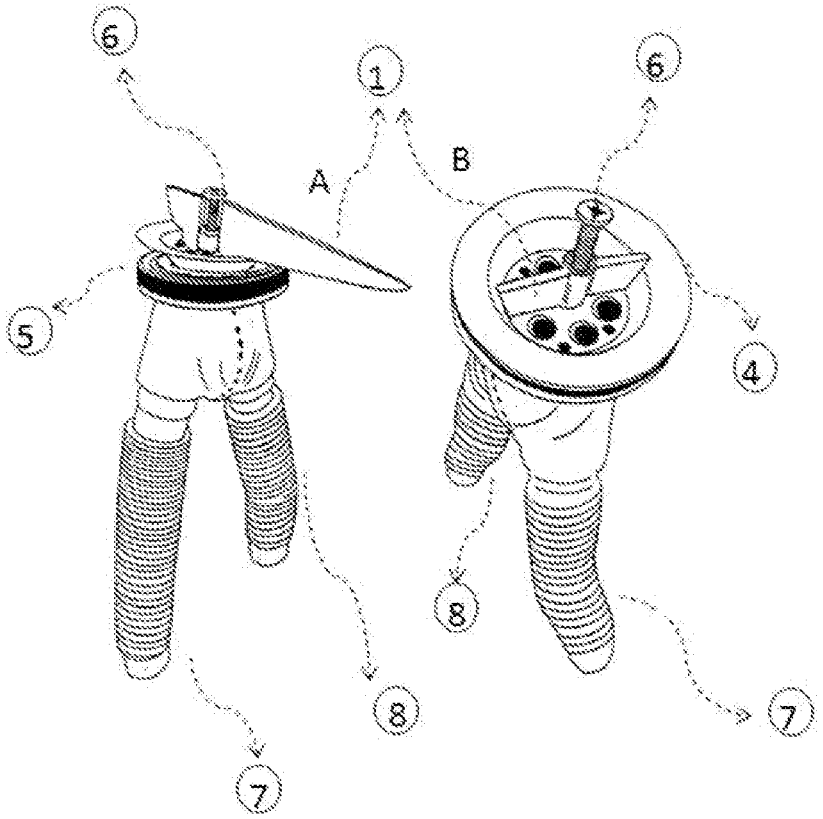
Figure ( 2 )

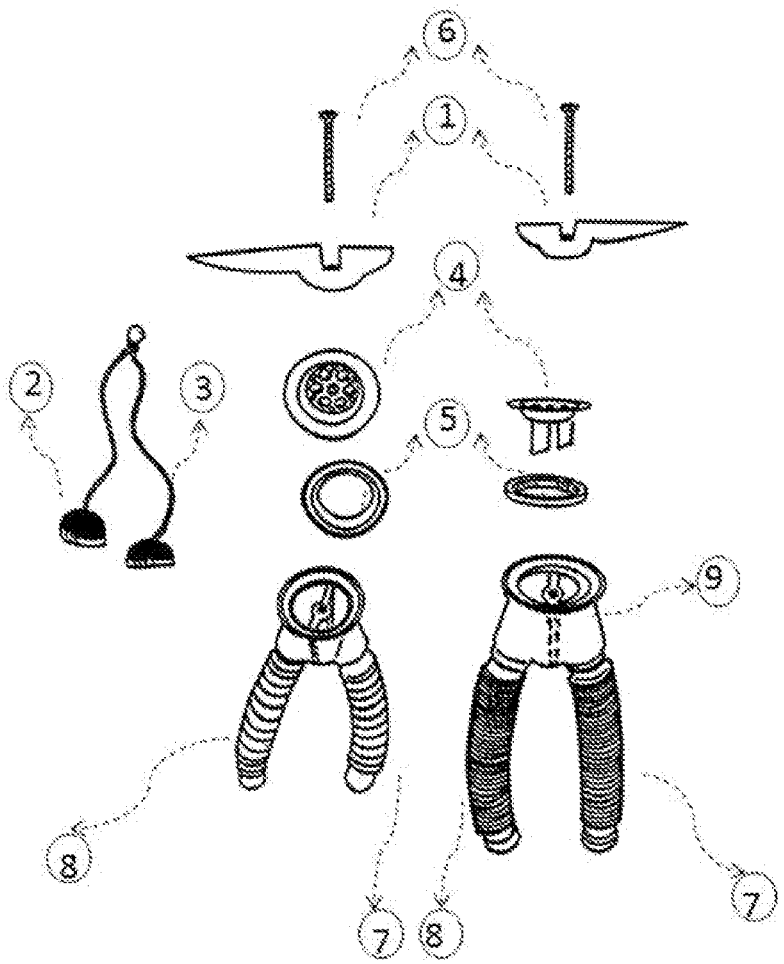
Figure (3)

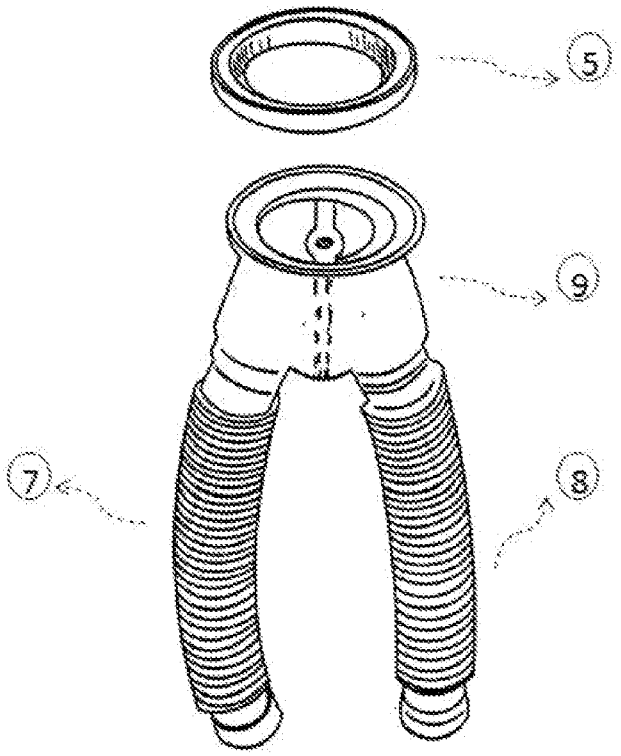
Figure ( 4 )

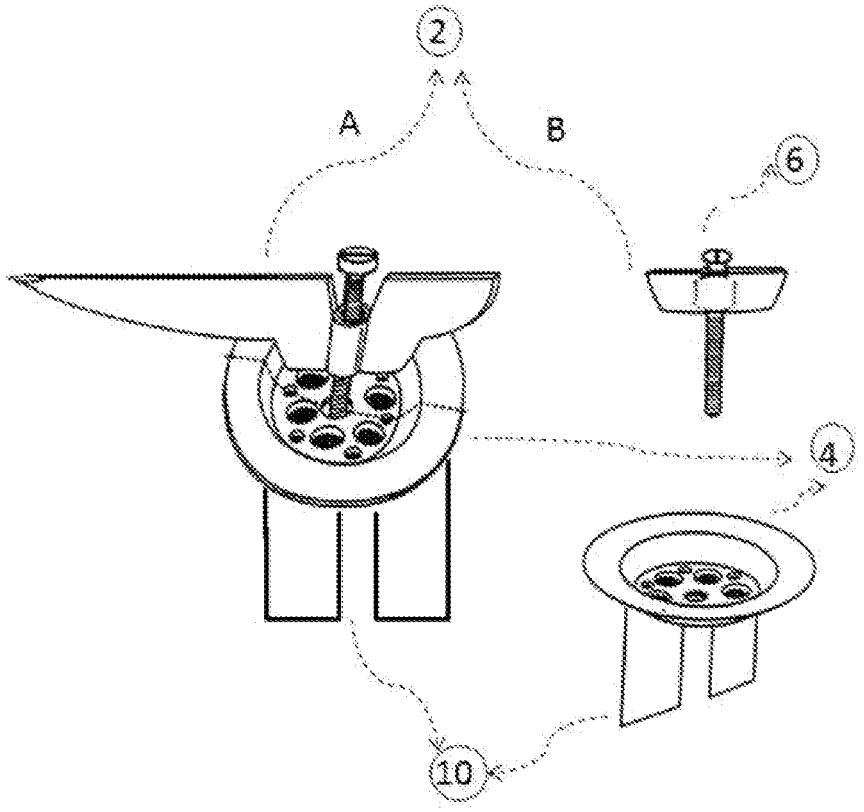
Figure ( 5 )

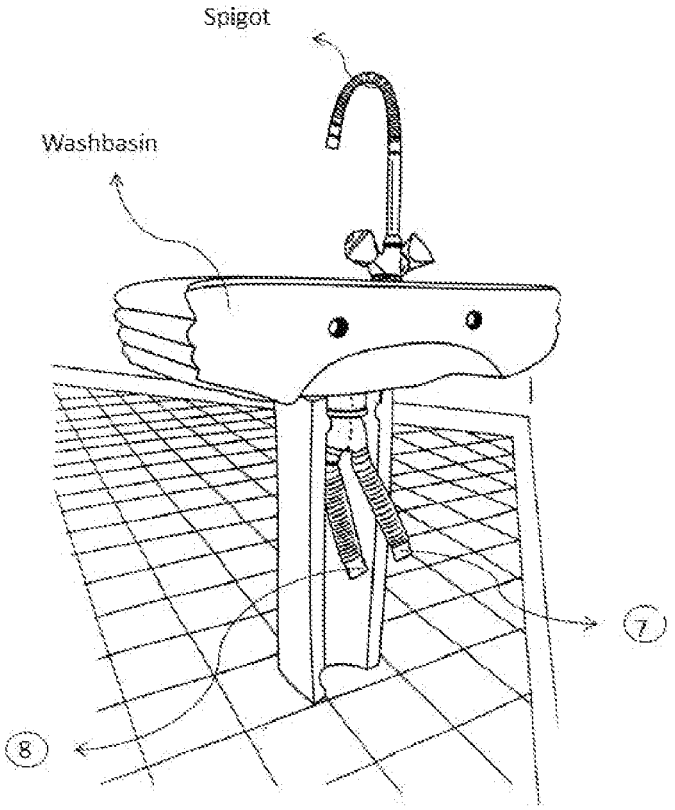
Figure ( 6 )

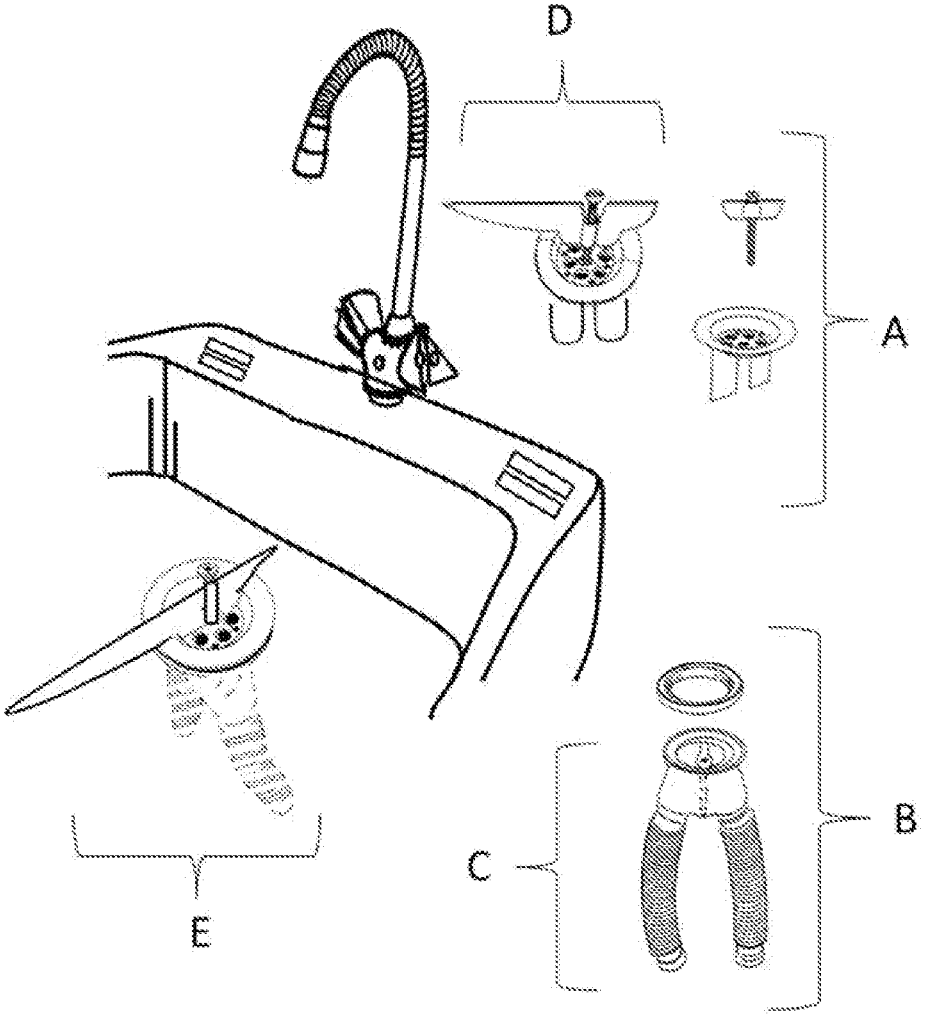
Figure ( 7 )

WASH BASIN WITH DUAL OUTLET OPENINGS SPLIT BY A SMALL PARTITION OF TWO EXTENDING ENDS FOR WATER SEPARATION

CROSS REFERENCE TO RELATED APPLICATIONS

This application is a National Stage of International Application No. PCT/SA2022/000008 filed Jul. 3, 2022, claiming priority based on Saudi Arabian Patent Application No. 121420876 filed Jul. 6, 2021.

BACKGROUND

It is well known that there is a need to find non-typical solutions for water shortage. The most important method of saving water is water recycling which is better than only satisfying with saving means as there are several uses of semi-pure water for toilet flushing, for home agriculture, or desert air-conditioning etc. US20150128339 relates generally to a sink, preferably a kitchen sink that is constructed from a commercially suitable material and having a divider for separating the sink basin into separate compartments.

WO2018113978A1 relates to hand washbasins working to separate used water for recycling low turbidity water and to discharge high turbidity water. FR2763085A1 relates to a device for the selective disposal of wastewater making it possible to distinguish the destination of recyclable wastewater, on the one hand, and the "lost" water, of somewhere else.

General Description

This invention is an excess water slot of dimensions conforming to the recognized dimensions to be installed in place of the previous one but with different inner design and it also works by a totally different mechanism. It was designed to separate pure water from other by a partition in the upper part of the excess water slot extending inside the wash basin and the lower part of the excess water slot ending with 2 pipe outlets one for pure water and the other for turbid water. The upper side means the upper part with drain holes in the middle of the wash basin. This separation is a small wall of 1-2 centimeter height as shown in 3 at (FIG. 2) with small flexible arms of extending ends as shown in 1 A (FIG. 5.) to separate water when it falls from the faucet down to the wash basin, and to allow using to rubber taps for each half of the excess water slot. One of the two outlets is directed to the public drain system and the other for recycling;

And The current invention relates to hand wash basin divided to two parts by a flexible thin wall and able to rotate the thin wall fixed at the top of an excess water slot also this wall has two extended ends with two separate outlets for the slot.

This invention is an excess water slot of dimensions conforming to the recognized dimensions to be installed in place of the previous one but with different inner design and it also works by a totally different mechanism. It was designed to separate pure water from other by a partition in the upper part of the excess water slot extending inside the wash basin and the lower part of the excess water slot ending with 2 pipe outlets one for pure water and the other for turbid water. The upper side means the upper part with drain holes in the middle of the wash basin.

BRIEF DESCRIPTION OF THE DRAWINGS

FIG. 1. shows the hand wash basin divided by a low partition by the divided excess water slot divided to two parts by a partition fixed to the slot.

FIG. 2. shows the full excess water slot with partition extension inside the wash basin or the partition fixed to the slot without being extended in the wash basin.

FIG. 3. shows the first upper set of the excess water slot.

FIG. 4. shows the Bottom fixture of the excess water slot which is fixed in the Bottom part of the hand wash basin.

FIG. 5. is a view of the upper side of the hand wash basin showing the excess water slot as written below.

FIG. 6. shows the Bottom side of the excess water slot in a small inverted cup open from the upper and Bottom sides.

FIG. 7. shows installation method, in which normal shape of the basin is revealed, also the innovation before and after the installation.

DETAILED DESCRIPTION

This invention is an excess water slot supporting with small slice to sorting water according to the degree of turbid in water as shown in 1 (FIG. 1) to be used for hand wash basins for recycling pure water resulting from daily used water. The used water of wash basins will be directed to two separate directions. Shown in 7 & 8 at (FIG. 2) The first one for semi-pure water and the other for turbid water. This excess water consists of two sets as shown in (FIGS. 4 & 5) one of them in the upper side of the wash basin and the other in the lower side of it. If the water resulting from washing is turbid, the user will close the right side by a half circular rubber tap as shown in 3 (FIG. 1) with an opening in the left side of the excess water slot to direct water to the public drain system as shown in 2 (FIG. 1). If the water resulting from washing is pure, the user will do the opposite of the above process by directing water to their outlet for recycling. The upper part of the excess water slot is spilled by a small partition which may have two prominent ends as shown in 1 (FIG. 2) in order to assist in dividing the wash basin to 2 halves: one (say the right side) for pure water and the other for highly turbid water. At hand wash, water will be taken from a flexible faucet as in most faucets. Recyclable water will be directed to the right half which is allocated for pure water. Then the user will shift his hands to the left side of the washbasin to complete the hand washing process, and then water full of turbidity, soap and, others will fall in the left part of the basin to be directed to the public drain system as shown in all (FIGS. 3 & 4 & 6). This excess water slot which is provided with two rubber taps can be replaced by a mechanical tap working by pressure on the long arm tap to facilitate opening and closing. The two parts can be closed together to allow the basin to be filled completely for private uses; or both halves will be opened and the faucet will be directed to the right half and the hands can be shifted between the two basins to make all water falling from the faucet directed to recycling. Water with soap, toothpaste and others will be directed to the left basin side and then to the public sewage system. This excess water slot consists of two sets: the first one is shown in (FIG. 5) which will be fixed to the upper side and consists of two taps each one of them is half a circle and a small pierced container to compensate for discharge space shortage and a small partition of two ends with a bolt to fix the upper part of the excess water slot to the lower one. The second set of the excess water slot shown in (FIG. 4) consists of a rubber frame for tight closure and a sleeve in the Figure of a small cup divided in the middle and open in the upper and Bottom sides. The Bottom opening is divided into two parts from the inside ending with two pipes, the right pipe for good recyclable water, and the left side is for directing water to the sewerage system. The parts are fixed by a bolt to the upper set of the excess water slot.

FIG. 1: shows the hand wash basin divided by a low partition by the divided excess water slot divided into two parts by a partition fixed to the slot.

1—double outlet with a flexible wall.

2—half circular rubber plug for sewage water.

3—half circular rubber plug for recycled water.

FIG. 2: shows the full excess water slot with partition extension inside the washbasin or the partition fixed to the slot without being extended in the washbasin.

1—small slice partition wall to sort the water inside the washbasin with an extended small wall.

and without an extended wall (only inside the slot).

4—cover with holes extended inward for water.

5—rubber ring.

6—serrated nail to connect the two parts.

7—pipe for pure recycled water.

8—pipe connect directly to the sewage network

FIG. 3: shows the first upper set of the excess water slot which is: (6) a bolt for fixing; (1) a small partition made of strong and flexible material in the middle of the pierced disc in the upper part of the slot and extension as shown in the Figure to be installed in the middle of the washbasin. It is made of flexible material or plastic to assist in the separation of water in the basin; (4) a small disc of multi pierces to be installed on the upper side; (2-3) two half-circle rubber taps by which the openings can be closed to control directing used water of the hand wash basin as shown in the figure:

1—a small slice of the partition wall to sort the water,

2-3—Two halves of rubber circles to control the two holes,

4—cover with holes extended inward for water,

5—rubber ring,

6—serrated nail to connect the two parts of the outlet,

7—pipe for pure recycled water,

8—pipe connect direct to the sewage network,

9—The main structure of the excess water slot.

FIG. 4: shows the Bottom fixture of the excess water slot which is fixed in the bottom part of the hand wash basin as shown in (FIG. 4):

(5) is a sealant rubber ring, (7) pipe for pure recycled water.

(8) pipe connects directly to the sewage network.

(9) incomplete funnel in the Figure of a small inverted cup open from the upper and Bottom sides with (8) and (7) outlets with a small partition in the middle as shown in (9). The purpose of this partition is to separate the falling water into two types: pure water and turbid water. Each one of the slot halves will be directed to one hose which can be controlled by directing to the direction we need; either to recycling or to the sewage system.

FIG. 5 is a view of the upper side of the hand wash basin showing the excess water slot as written below:

The upper part of the tub outlet tools

2—is a small slice partition wall to sort the water inside the washbasin

A—with an extended small wall.

B—without an extended wall (only inside the slot).

4—cover with holes extended inward for water.

6—serrated nail to connect the two parts of the water slot outlet.

10—slide extended down for water sorting.

FIG. 6: shows the Bottom side of the excess water slot in the Figure of a small inverted cup open from the upper and Bottom sides fixed to 2 separate hoses and internally divided into two parts.

7—pipe for pure recycled water,

8—pipe connect direct to the sewage network,

FIG. 7 shows installation method, in which normal shape of the basin is revealed, also the innovation before and after the installation; and it is divided into groups; ABCDE, each group has its certain characteristics as the following below:

Some parts will be installed on the top side of the basin; they are arranged in gradient; perforated plate followed by a separator and topped with a screw, Some parts will be installed on the bottom side of the basin and a rubber ring in the bottom which fabricated as one part and the base which is in a form of an upside-down cup with 2 pipes that should be fixed by pressing, This part should be fabricated with one connected molding, This part should be fabricated at the top of the basin, with a small flexible partition extended inside the basin, Excess water drainage outlet after it has been installed in the tub, and the dotted part is at the bottom of the basin, and the connection between the upper and the lower parts is by one screw as usual.

Method of Application:

This device is targeted to serve within an existing environment which is the basin of hands washing that is found in our homes, workplaces, and all buildings all around the world; that means innovation will simply be added to those devices; therefore it must be in accordance with their specifications associated, the following below is a brief method of installation:

A detailed graphic is enclosed (FIG. 8) to facilitate how to install: in which normal shape of the basin was explained, also the innovation before and after the installation, it is divided into groups, ABCDE, each group has its certain characteristics as the following below: (A) some parts will be installed on the top side of the basin, (B) some parts will be installed on the bottom side of the basin, (C this part will be fabricated with one connected molding (D) this part will be fabricated with edges extending in the middle of the basin, (E) excess water outlet after it has been installed in the basin the dotted part is installed from the bottom, steps of installation are the following below:

The previous drainage outlet must be disassembled if any.

The small perforated dish must be put in its normal place, firstly from the top with the small partition.

The rubber frame should be put on the top of the (B) group and to be centered before the screw fastening.

The body of drainage outlet (B) which is in the upside-down cup should be put on the left side of the basin against the opening including the rubber ring that obstructs leakage, which is explained in (B).

The screw must be fastened in order to fix both sides of the drainage outlet, therefore the installation is finished.

So, it reveals the easiness and adequacy of installation for each washing basin with its normal dimensions without any problems, and by normal workers without problems.

The invention claimed is:

1. A hand wash basin comprising:

an opening configured to drain excess water;

a rotatable partition wall configured to sort water according to water turbidity, wherein the partition wall is configured to separate an upper side of the opening;

two rubber taps configured to open and close the opening;

a perforated disc provided on the upper side of the opening, the perforated disc being configured to separate used water;

a rubber ring configured to obstruct leakage;

a screw configured to fix the partition wall to the perforated disc, wherein a longitudinal axis of the screw extends perpendicular to a top surface of the perforated disc, and wherein the partition wall is rotatable about the longitudinal axis of the screw;

a first outlet connected to a first pipe configured to drain clean water to a recycling system; and a second outlet connected to a second pipe configured to drain turbid water to a sewage system, wherein the partition wall is fixed to a top of the opening.

2. The hand wash basin according to claim 1, wherein the partition wall is configured to separate an upper basin.

3. The hand wash basin according to claim 1, further comprising:

a funnel comprising an inverted cup open from upper and lower sides with outlets;

a partition provided in a middle of the funnel to separate falling water according to whether the falling water is clean water or turbid water; and a first slot half configured to direct clean water to the first pipe for recycling; and a second slot half configured to direct turbid water to the second pipe for the sewage system.

4. The hand wash basin according to claim 1, wherein the hand wash basin is configured as a manual or automatic separation instrument.

* * * * *